US009017140B2

(12) United States Patent
Allison et al.

(10) Patent No.: US 9,017,140 B2
(45) Date of Patent: Apr. 28, 2015

(54) CMP PAD WITH LOCAL AREA TRANSPARENCY

(75) Inventors: William Allison, Beaverton, OR (US); Ping Huang, St. Louis Park, MN (US); Diane Scott, Portland, OR (US); Richard Frentzel, Murrieta, CA (US); Robert Kerprich, Portland, OR (US)

(73) Assignee: NexPlanar Corporation, Hillsboro, OR (US)

( * ) Notice: Subject to any disclaimer, the term of this patent is extended or adjusted under 35 U.S.C. 154(b) by 962 days.

(21) Appl. No.: 12/657,135

(22) Filed: Jan. 13, 2010

(65) Prior Publication Data

US 2011/0171883 A1 Jul. 14, 2011

(51) Int. Cl.
*B24B 49/12* (2006.01)
*B24B 37/20* (2012.01)

(52) U.S. Cl.
CPC ..... *B24B 37/205* (2013.01)

(58) Field of Classification Search
USPC ..... 451/6, 287, 288, 289, 290, 533, 534, 451/526, 527; 51/297, 298, 293
See application file for complete search history.

(56) References Cited

U.S. PATENT DOCUMENTS

| | | | |
|---|---|---|---|
| 5,433,651 | A | 7/1995 | Lustig et al. |
| 5,605,760 | A | 2/1997 | Roberts |
| 5,609,517 | A | 3/1997 | Lofaro |
| 5,733,176 | A | 3/1998 | Robinson et al. |
| 5,893,796 | A | 4/1999 | Birang et al. |

(Continued)

FOREIGN PATENT DOCUMENTS

| | | |
|---|---|---|
| CN | 1437520 | 8/2003 |
| JP | 2008546167 | 12/2008 |

(Continued)

OTHER PUBLICATIONS

International Search Report and Written Opinion for International Patent Application No. PCT/US2011/020870, mailed May 13, 2011, 10 pgs.

(Continued)

*Primary Examiner* — Robert Rose
(74) *Attorney, Agent, or Firm* — Blakely Sokoloff Taylor & Zafman LLP

(57) ABSTRACT

A CMP polishing pad comprising (a) a polishing layer having a polishing surface and a back surface opposite said polishing surface; said polishing layer having at least one cured opaque thermoset polyurethane region and at least one aperture region; said at least one cured opaque thermoset region has a porosity from about 10% to about 55% by volume; said at least one aperture region having (1) a top opening positioned below the polishing surface, (2) a bottom opening that is co-planar with said back surface and (3) straight line vertical sidewalls extending from said aperture top opening to said aperture bottom opening; said at least one aperture region filled with a cured plug of thermoset polyurethane local area transparency material that has a light transmission of less than 80% at a wavelength from 700 to 710 nanometers and is chemically bonded directly to a thermoset polyurethane opaque area;

(b) an aperture-free removable release sheet covering at least a portion of said back surface of the polishing layer; and (c) an adhesive layer interposed between said polishing layer and said release sheet; said adhesive layer capable of adhering the polishing layer to a platen of a CMP apparatus after said release sheet has been removed.

13 Claims, 2 Drawing Sheets

(56) References Cited

U.S. PATENT DOCUMENTS 6,045,439 A 4/2000 Birang et al.
6,068,539 A 5/2000 Bajaj et al.
6,146,242 A 11/2000 Treur et al.
6,171,181 B1 1/2001 Roberts et al.
6,254,459 B1 7/2001 Bajaj et al.
6,280,290 B1 8/2001 Birang et al.
6,358,130 B1 3/2002 Freeman et al.
6,387,312 B1 5/2002 Roberts et al.
6,428,386 B1 8/2002 Barlett
6,454,630 B1 9/2002 Tolles
6,458,014 B1 10/2002 Ihsikawa et al.
6,517,417 B2 2/2003 Budinger et al.
6,524,164 B1 2/2003 Tolles
6,524,176 B1 2/2003 Cheng et al.
6,537,133 B1 3/2003 Birang et al.
6,537,134 B2 3/2003 Newell
6,544,104 B1 4/2003 Koike et al.
6,604,985 B2 8/2003 Muilenburg et al.
6,623,331 B2 9/2003 Sevilla et al.
6,641,470 B1 11/2003 Zhao et al.
6,676,483 B1 1/2004 Roberts
6,676,717 B1 1/2004 Birang et al.
6,685,537 B1 2/2004 Fruitman et al.
6,702,866 B2 3/2004 Kamboj
6,716,085 B2 4/2004 Wiswesser et al.
6,719,818 B1 4/2004 Birang et al.
6,722,249 B2 4/2004 David
6,726,528 B2 4/2004 Barbour
6,752,690 B1 * 6/2004 Fruitman ..... 451/6
6,786,810 B2 9/2004 Muilenburg et al.
6,806,100 B1 10/2004 Zu et al.
6,824,447 B2 11/2004 Takahashi et al.
6,832,947 B2 * 12/2004 Manning ..... 451/41
6,832,949 B2 12/2004 Konno et al.
6,832,950 B2 12/2004 Wright et al.
6,840,843 B2 1/2005 Jones et al.
6,855,034 B2 2/2005 Hasegawa
6,860,791 B2 3/2005 Birang et al.
6,860,793 B2 3/2005 Budinger et al.
6,866,559 B2 3/2005 Lehman et al.
6,875,077 B2 4/2005 Petroski et al.
6,875,078 B2 4/2005 Birang et al.
6,876,454 B1 4/2005 Birang et al.
6,884,150 B2 4/2005 Barbour
6,884,156 B2 4/2005 Prasad et al.
6,896,585 B2 5/2005 Tolles
6,910,944 B2 6/2005 Birang et al.
6,945,846 B1 9/2005 Petroski et al.
6,960,120 B2 11/2005 Prasad
6,984,163 B2 1/2006 Roberts
6,986,700 B2 1/2006 Agarwal
6,986,701 B2 1/2006 Halley et al.
6,986,705 B2 1/2006 Preston et al.
6,994,607 B2 2/2006 Wiswesser
6,997,777 B2 2/2006 Newell
7,011,565 B2 3/2006 Birang et al.
7,018,581 B2 * 3/2006 David et al. ..... 264/235
7,052,368 B2 5/2006 Kim et al.
7,081,044 B2 7/2006 Ohta et al.
7,083,497 B2 8/2006 Halley et al.
7,112,119 B1 9/2006 Swedek et al.
7,118,450 B2 10/2006 Birang et al.
7,118,457 B2 10/2006 Swedek et al.
7,132,033 B2 11/2006 Boldizar et al.
7,160,181 B2 1/2007 Jeung
7,163,437 B1 1/2007 Swedek et al.
7,169,017 B1 1/2007 Saikin
7,179,151 B1 2/2007 Bottema et al.
7,182,670 B2 2/2007 Muldowney
7,183,213 B2 2/2007 Shiho et al.
7,189,141 B2 3/2007 Tolles
7,195,539 B2 3/2007 Turner et al.
7,195,541 B2 3/2007 Wolf
7,198,544 B2 4/2007 Wiswesser
7,204,742 B2 4/2007 Prasad
7,210,980 B2 5/2007 Swedek et
7,226,339 B2 6/2007 Benvegnu et al.
7,229,337 B2 6/2007 Lim et al.
7,238,097 B2 7/2007 Ohno et al.
7,241,408 B2 7/2007 Shih et al.
7,252,871 B2 8/2007 Crkvenac et al.
7,255,629 B2 8/2007 Birang et al.
7,258,602 B2 8/2007 Shih et al.
7,264,536 B2 9/2007 Wiswesser et al.
7,267,607 B2 9/2007 Prasad
7,273,407 B2 9/2007 Saikin
7,291,063 B2 11/2007 Swisher et al.
7,306,507 B2 12/2007 Benvegnu et al.
D559,063 S 1/2008 Okamoto et al.
D559,065 S 1/2008 Miyauchi et al.
D559,648 S 1/2008 Miyauchi et al.
D560,457 S 1/2008 Miyauchi et al.
7,323,415 B2 1/2008 Shiho et al.
7,354,334 B1 4/2008 Birang et al.
7,374,477 B2 5/2008 Birang et al.
7,377,840 B2 5/2008 Deopura et al.
D576,855 S 9/2008 Okamoto et al.
7,425,172 B2 9/2008 Misra et al.
7,429,210 B2 9/2008 Bonner et al.
7,435,165 B2 10/2008 Prasad
7,442,111 B2 10/2008 Lim et al.
D581,237 S 11/2008 Okamoto et al.
7,455,571 B1 11/2008 Kuo et al.
7,497,763 B2 3/2009 Bottema et al.
7,513,818 B2 4/2009 Miller et al.
7,547,243 B2 6/2009 Wiswesser et al.
7,553,214 B2 6/2009 Menk et al.
7,614,933 B2 11/2009 Benvegnu et al.
7,621,798 B1 11/2009 Bennett et al.
7,651,385 B2 1/2010 Benvegnu et al.
7,662,022 B2 2/2010 Lim et al.
7,927,183 B2 * 4/2011 Fukuda et al. ..... 451/6
7,942,724 B2 * 5/2011 Benvegnu et al. ..... 451/6
2001/0036805 A1 11/2001 Birang et al.
2002/0137431 A1 9/2002 Labunsky
2003/0171081 A1 * 9/2003 Komukai et al. ..... 451/285
2003/0207661 A1 * 11/2003 Tregub et al. ..... 451/550
2004/0082271 A1 4/2004 Wiswesser et al.
2004/0094855 A1 5/2004 Shih et al.
2004/0102141 A1 5/2004 Swisher et al.
2004/0203320 A1 10/2004 Hosaka et al.
2004/0209066 A1 10/2004 Swisher et al.
2004/0224611 A1 11/2004 Aoi et al.
2005/0009448 A1 1/2005 Misra et al.
2005/0148183 A1 7/2005 Shiro et al.
2005/0170751 A1 8/2005 Birang et al.
2005/0173259 A1 8/2005 Mavliev et al.
2005/0221723 A1 10/2005 Duboust et al.
2005/0245171 A1 11/2005 Hosaka et al.
2006/0019587 A1 1/2006 Deopura et al.
2006/0037699 A1 * 2/2006 Nakamori et al. ..... 156/345.12
2006/0154568 A1 7/2006 Tolles
2006/0198992 A1 9/2006 Shih et al.
2006/0276109 A1 12/2006 Roy et al.
2006/0291530 A1 12/2006 Tregub et al.
2007/0010169 A1 1/2007 Swisher et al.
2007/0015441 A1 1/2007 Birang et al.
2007/0021045 A1 1/2007 Swisher et al.
2007/0037487 A1 2/2007 Kuo et al.
2007/0049169 A1 3/2007 Vaidya et al.
2007/0093191 A1 4/2007 Wang et al.
2007/0190905 A1 8/2007 Shimomura et al.
2007/0197134 A1 8/2007 Menk et al.
2007/0197145 A1 8/2007 Menk et al.
2008/0003923 A1 1/2008 Benvegnu et al.
2008/0090498 A1 4/2008 Misra et al.
2008/0207100 A1 8/2008 Roy et al.
2008/0211141 A1 9/2008 Deopura et al.
2008/0305729 A1 12/2008 Benvagnu et al.
2009/0023363 A1 1/2009 Bottema et al.
2009/0053976 A1 2/2009 Roy et al.
2009/0137188 A1 5/2009 Fukuda et al.
2009/0137189 A1 5/2009 Fukuda et al.
2009/0142989 A1 6/2009 Lefevre et al.

(56) References Cited

U.S. PATENT DOCUMENTS

| | | | |
|---|---|---|---|
| 2009/0253353 | A1 | 10/2009 | Ogawa et al. |
| 2009/0305610 | A1 | 12/2009 | Yilmaz et al. |
| 2009/0311955 | A1 | 12/2009 | Kerprich et al. |
| 2009/0318061 | A1 | 12/2009 | Taylor et al. |
| 2010/0035519 | A1 | 2/2010 | Benvegnu et al. |

FOREIGN PATENT DOCUMENTS

| | | |
|---|---|---|
| JP | 2009224384 | 10/2009 |
| JP | 2011520634 | 7/2011 |
| TW | 200408494 | 6/2004 |
| TW | 200416102 | 9/2004 |
| TW | 200639019 | 11/2006 |
| WO | WO-2006089293 | 8/2006 |

OTHER PUBLICATIONS

Office Action for Chinese Patent Application No. 20118000058986, mailed Apr. 28, 2014, 6 pgs.

Office Action for European Patent Applicatin No. 11700493.7, mailed Aug. 26, 2014, 4 pgs.

Office Action for European Patent Application No. 11700493.7, mailed Dec. 18, 2013, 4 pgs.

Office Action for Japanese Patent Application No. 2012-549005, mailed Sep. 9, 2013, 6pgs.

Office Action for Korean Patent Application No. 10-2012-7019401, mailed May 9, 2014, 8 pgs.

International Preliminary Report on Patentability from PCT/US2011/020870 mailed Jul. 26, 2012, 7 pgs.

Written Opinion from Signapore Patent Application No. 201204908-6 mailed Sep. 9, 2013, 6 pgs.

Office Action for Taiwan Patent Application No. 100101301, mailed Jun. 10, 2014, 6 pgs.

Office Action for Taiwan Patent Application No. 100101301, mailed Oct. 23, 2013, 4 pgs.

Search Report from Taiwan Patent Application No. 100101301 mailed Oct. 22, 2013, 1 pgs.

Search Report from Taiwan Patent Application No. 100101301 mailed Jun. 9, 2014, 1 pgs.

* cited by examiner 18
20
22
24
26
28
40
42
44
46
48
50
52
54
56
60
62

CMP PAD WITH LOCAL AREA TRANSPARENCY

FIELD

The present invention is related to a CMP polishing pad with at least one local area transparency (sometimes referred herein as a LAT), and more particularly, to an assembly useful for making such a LAT polishing pad, as well as processes for making and using such a LAT polishing pad.

BACKGROUND

Chemical mechanical planarization, also called chemical mechanical polishing (and commonly abbreviated CMP), includes processes that are used in the manufacturing of microelectronic devices to form flat surfaces on semiconductor wafers, field emission displays, and many other microelectronic substrates. For example, the manufacture of semiconductor devices generally involves the formation of various process layers, selective removal or patterning of portions of those layers, and deposition of yet additional process layers above the surface of a semiconducting substrate to form a semiconductor wafer. The process layers can include, by way of example, insulation layers, oxide layers, conductive layers, and layers of metal or glass, and the like. It is generally desirable in certain steps of the wafer process that the uppermost surface of the process layers be planar, i.e., flat, for the deposition of subsequent layers. CMP is used to planarize process layers wherein a deposited material, such as a conductive or insulating material, is polished to planarize the wafer for subsequent process steps.

A conventional CMP process involves pressing a substrate (e.g. a wafer substrate) against a rotating polishing pad in the presence of a polishing compound (also referred to as a polishing slurry). The polishing pad is held on a platen in the CMP apparatus whereas the substrate wafer being polished is held above the polishing pad with a dynamic polishing head. The dynamic polishing head holding the wafer and the polishing pad can be rotated in the same direction or in opposite directions, whichever is desirable for the particular polishing process being carried out. The polishing slurry generally is introduced between the rotating wafer and the rotating polishing pad during the polishing process. The polishing slurry typically contains one or more chemicals that interact with or dissolve portions of the uppermost wafer layer(s) and an abrasive material that physically removes portions of the layer(s). This action removes material from the substrate and tends to even out irregular topography on the substrate, making the substrate surface flat or planar. For example, such CMP operations may be used to either bring the entire substrate surface within the depth of focus for a following photolithography operation, or to selectively remove material based on its position on the substrate.

In general, there is a need to detect when the desired surface planarity or layer thickness has been reached or when an underlying layer has been exposed in order to determine whether to stop polishing. Several techniques have been developed for the in situ detection of endpoints during the CMP process. For example, an optical monitoring system for in-situ measuring of uniformity of a layer on a substrate during polishing of the layer has been employed. The optical monitoring system can include a light source that directs a light beam toward the substrate during polishing, a detector that measures light reflected from the substrate, and a computer that analyzes a signal from the detector and calculates whether the endpoint has been detected. In some CMP systems, the light beam is directed toward the substrate through the local area transparency in the polishing pad.

Such polishing pads having local area transparencies are known in the art and have been used to polish work pieces, such as semiconductor devices. For example, U.S. Pat. No. 5,893,796 discloses removing a portion of a polishing pad to provide an aperture and placing a transparent two-section top hat design polyurethane or quartz plug in the aperture to provide the local area transparency. Typically, local area transparencies are mounted into the top polishing pad layer and are either flush with the top polishing surface of the polishing pad or are recessed from the polishing surface. Local area transparencies that are mounted flush can become scratched and clouded during polishing and/or during conditioning resulting in polishing defects and hindering endpoint detection. Accordingly, it is desirable to recess the local area transparency from the plane of the polishing surface to avoid scratching or otherwise damaging the LAT. Polishing pads having recessed local area transparencies are disclosed in U.S. Pat. Nos. 5,433,651, 6,146,242, 6,254,459, 6,280,290, and 7,195,539 as well as U.S. Published Patent Application Nos. 2002/0042243 A1 and 2003/0171081 A1.

Conventional methods for affixing a LAT into a polishing pad typically involve either the use of an adhesive to attach the local area transparency to the pad, or an integral molding method. Such conventional methods produce polishing pads which may suffer one or both of the following problems: (1) the seal between the polishing pad and the local area transparency is either imperfect or deteriorates during use such that polishing slurry leaks through this imperfection and onto the platen or behind the local area transparency thus compromising optical clarity for endpoint detection, and (2) the local area transparency may separate from the polishing pad during use and be ejected because the slurry may compromise the adhesive interface.

Thus, there remains a need for an effective polishing pad comprising a translucent region (e.g., local area transparency) that avoids wear by the workpiece because it is recessed and can be produced using efficient and inexpensive methods. The present invention provides such a polishing pad, as well as methods of making such pads. These and other advantages of the present invention, as well as additional inventive features, will be apparent from the description of the invention provided herein.

SUMMARY

The various embodiments of the present invention address the above needs and achieve other advantages.

One aspect of the present invention is directed to a CMP polishing pad comprising (a) a polishing layer having a polishing surface and a back surface opposite said polishing surface; said polishing layer having at least one cured closed cell, thermoset polyurethane or polyurea opaque region and at least one aperture region; said at least one cured thermoset opaque region has a porosity from about 10% to about 55% by volume; said at least one aperture region having (1) a top opening positioned below the polishing surface that is surrounded by a plateau plane, (2) a bottom opening that is flush with said back surface and (3) straight line vertical sidewalls extending from said aperture top opening to said aperture bottom opening; said at least one aperture region containing a cured thermoset polyurethane or polyurea local area transparency material that has a light transmission of less than 80% at a wavelength of 700-710 nanometers that is chemically bonded directly to a thermoset polyurethane or polyurea opaque area; (b) an aperture-free removable release sheet covering at least a portion of said back surface of the polishing layer; and (c) an adhesive layer interposed between said polishing layer and said release sheet; said adhesive layer capable of adhering the polishing layer backside to a platen of a CMP apparatus after said release sheet has been removed.

A second aspect of the present invention is directed to an assembly that is a non-liquid, non-cured thermoset local area transparency intermediate material having a surface affixed to at least one support member.

A third aspect of the present invention is directed to a method of making a CMP polishing pad that comprises the steps of: (1) providing a first assembly of a non-liquid, non-cured thermoset local area transparency intermediate material having one surface affixed to at least one support member; (2) positioning said first assembly in a polishing pad making apparatus whereby the affixed surface of the local area transparency intermediate material is located between the polishing surface and bottom surface of the polishing pad that will be formed in the apparatus; (3) introducing opaque thermoset intermediate material into said polishing pad making apparatus; (4) co-curing the thermoset local area transparency intermediate material and the opaque thermoset intermediate material to form a polishing layer having a polishing surface and a back surface opposite said polishing surface; said polishing layer having at least one cured closed cell, thermoset polyurethane or polyurea opaque region and at least one aperture region; said at least one cured thermoset opaque region has a porosity from about 10% to about 55% by volume; said at least one aperture region having (a) a top opening positioned below the polishing surface that is surrounded by a plateau plane, (b) a bottom opening that is coplanar with said back surface and (c) straight line vertical sidewalls extending from said aperture top opening to said aperture bottom opening; said at least one aperture region containing a cured thermoset polyurethane or polyurea local area transparency material.

A fourth aspect of the present invention is directed to the method of the third aspect of the present invention which further comprises (5) removing a back portion of the polishing layer to form a polishing pad of predetermined desired thickness, said removing step creating a new bottom surface of the thermoset local area transparency so that the thermoset local area transparency is coplanar with the back surface of the opaque portion of the pad; alone, or with (6) attaching an aperture-free removable release sheet covering at least a portion of said back surface of the polishing layer with an adhesive layer interposed between said polishing layer and said release sheet; said adhesive layer capable of adhering the polishing layer to a platen of a CMP apparatus after said release sheet has been removed.

A fifth aspect of the present invention is directed to a method of producing a workpiece, which comprises a step of polishing a surface of a workpiece with a polishing pad of the type recited in the first aspect of the present invention.

BRIEF DESCRIPTION OF THE SEVERAL VIEWS OF THE DRAWINGS

Figure 1:
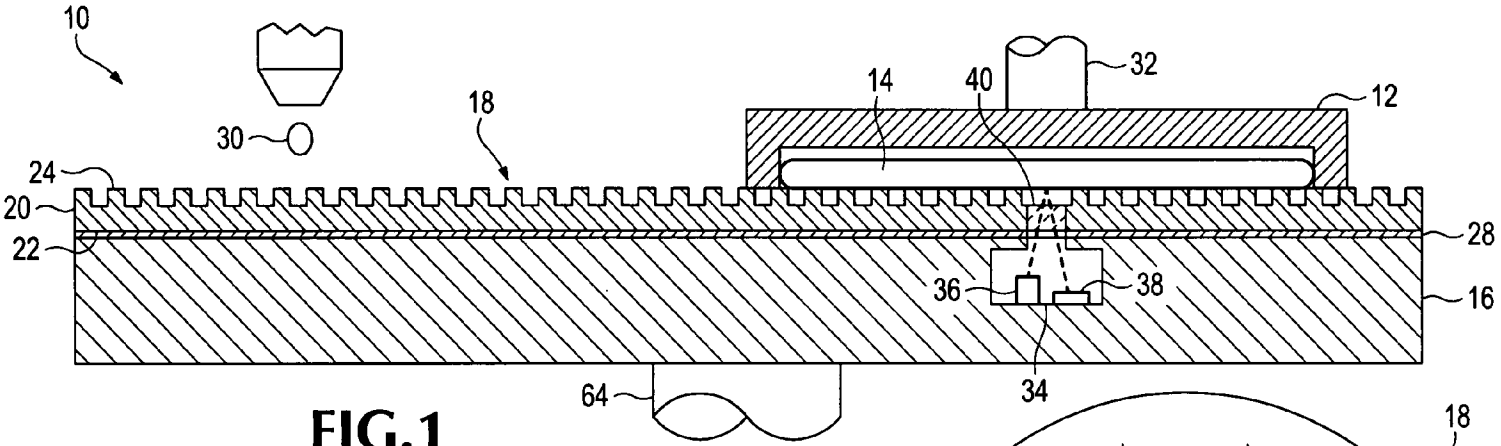
Figure 2:
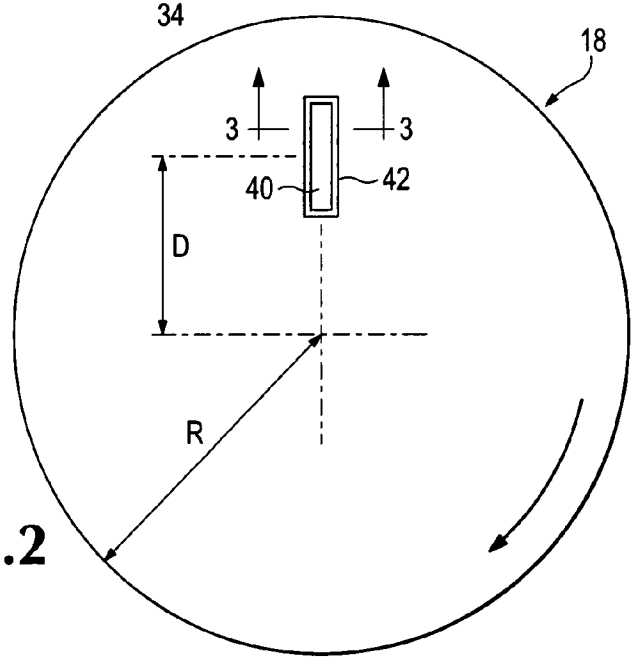
Figures 3, 4, 5:
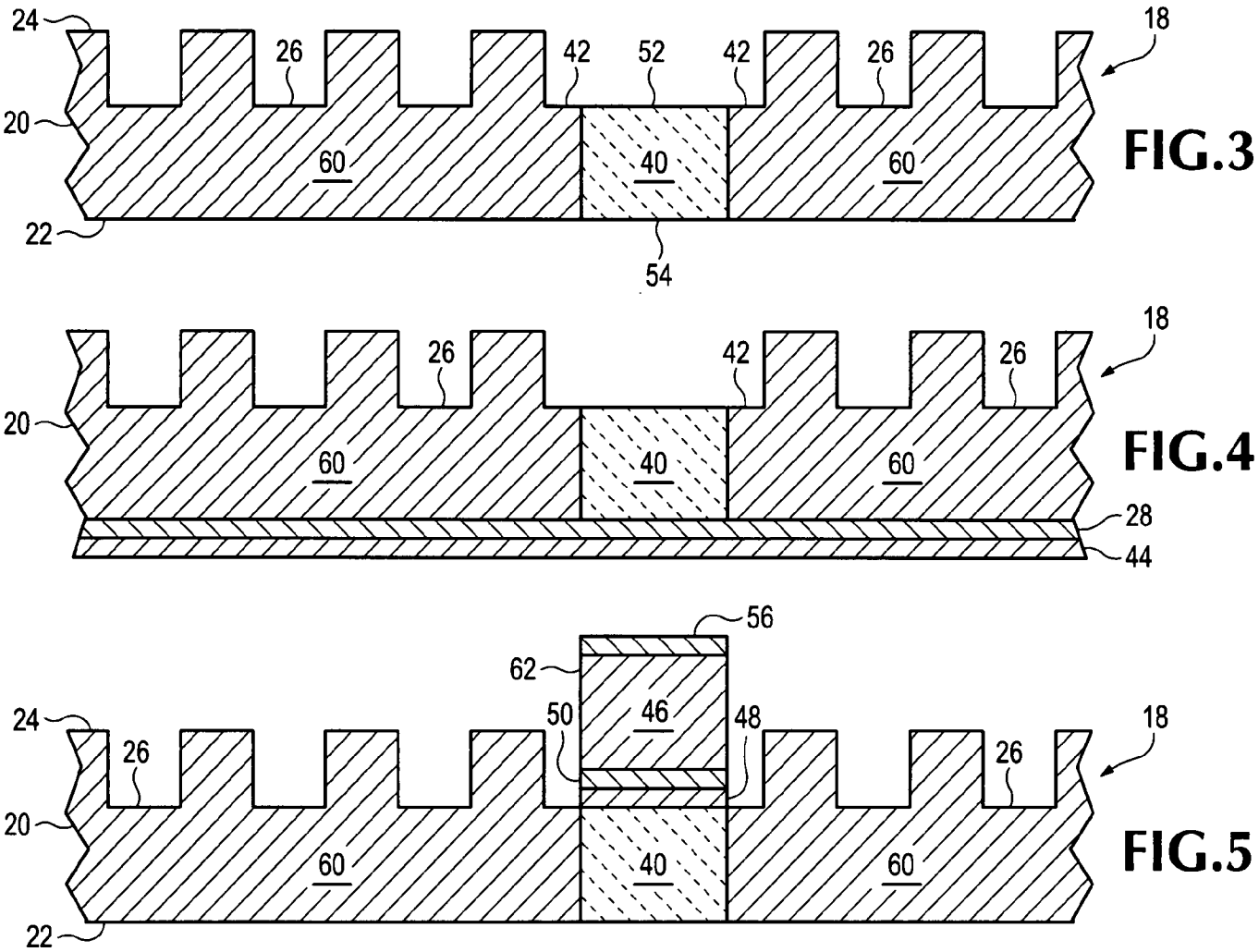

Having thus described the invention in general terms, reference will now be made to the accompanying drawings, which are not necessarily drawn to scale and are meant to be illustrative and not limiting, and wherein:

FIG. 1 is a cross-sectional view of a CMP apparatus containing a polishing pad;

FIG. 2 is a top view of an embodiment of a polishing pad with a LAT;

FIG. 3 is a cross-sectional view of the polishing pad of FIG. 2;

FIG. 4 is cross-sectional view FIG. 3 with a removable release sheet affixed to the back surface of the polishing pad and an adhesive layer interposed between said polishing layer and said release sheet; and FIG. 5 is cross-sectional view FIG. 3 with a removable support attached to the top surface of the local area transparency by means of a adhesive layer and releasable layer interposed between said support and said local area transparency.

Like numbers refer to like elements throughout.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements.

The term "closed cell" as used in the present specification and claims refers to the type of porosity or pores used in the pad. These closed cell pores are microcellular in nature, independent of each other and are different than the open cell or network of interconnected or reticulated cell pores that are also used in other CMP pads.

The terms "local area transparency" or "LAT" as used in the present specification and claims refers to a translucent material (i.e. having less than 80% transparency at a wavelength of 700 to 710 nanometers) which is suitable for use to allow for endpoint detection in a CMP apparatus equipped with an optical endpoint system that would use such a LAT.

The terms "non-liquid, non-fully cured"; "partially cured" and "local area transparency intermediate material" as used in the present specification and claims refers to the thermoset polyurethane or polyurea resin composition that is partially cured to a non-liquid state (e.g. a gel-like or semi-solid material having reactive groups on its surface that can react with reactive groups in the uncured opaque portion of the psd during compression molding or oven curing or both) and that is capable of being attached to a support member and then be accurately positioned in compression mold apparatus to form a recessed LAT in a CMP pad.

The term "opaque" as used in the present specification and claims refers to those portions of the CMP pad that are much less transparent than the LAT. Preferably, the opaque regions of the pad would be opaque or nearly opaque in nature (e.g. having less than 10% transparency at a wavelength of 700 to 710 nanometers).

The term "porosity" as used in the present specification and claims includes gas-filled particles, gas-filled spheres (e.g. expanded hollow-polymeric microspheres) and other porogens as well as voids formed from other means, such as mechanically frothing gas into a viscous system, injecting gas into the polyurethane/polyurea melt, introducing gas in situ using a chemical reaction with gaseous product, or decreasing pressure to cause dissolved gas to form bubbles. The polishing pads of the present invention contain a porosity concentration of about 10% to about 55% by volume. The porosity contributes to the polishing pad's ability to transfer polishing fluids during polishing. Preferably, the polishing pad has a porosity concentration of about 20% to about 40% by volume. Preferably, the pores particles have an average diameter of 10 to 100 .mu.m (microns). More preferably, the pores particles have an average diameter of 12 to 90 .mu.m (microns). In the case of expanded hollow-polymeric microspheres, the preferred average diameter is from about 12 to about 80 .mu.m. (microns).

The term "thermoset polyurethane or polyurea" as used in the present specification and claims refers to any polyurethane or polyurea cured polymer made by curing a thermosetting polyurethane or polyurea prepolymer or combinations thereof. Preferably, the curing is caused by heat energy in a compression molding apparatus. Thermoset polyurethanes and polyureas of the present invention are distinguished from thermoplastic polyurethane or polyurea polymers that also have been used to make CMP pads.

As shown in FIG. 1, the CMP apparatus 10 includes a polishing head 12 for holding a workpiece such as a semiconductor substrate 14 against a polishing pad 18 on a platen 16. The CMP apparatus may be constructed as described in U.S. Pat. No. 5,738,574, which is incorporated herein by reference in its entirety.

Referring to FIG. 2, in some implementations the polishing pad 18 has a radius R of 15.0 inches (381.00 mm), with a corresponding diameter of 30 inches. In other implementations, the polishing pad 18 can have a radius of 10.0 inches, 15.25 inches (387.35 mm) or 15.5 inches (393.70 mm), with corresponding diameters of 20 inches, 30.5 inches or 31 inches.

Referring to FIG. 3, in some implementations, grooves 26 can be formed in-situ in the polishing surface 24. The grooves can be in any suitable pattern and can have any suitable depth, width and pitch. For example, the grooves 26 preferably have a depth from about 0.015 to 0.100 inches (15 mils to 100 mils or from 0.381 mm to 2.54 mm). The grooves 26 may preferably have a width of from about 0.015 to 0.050 inches (15 mils to 50 mils of from 0.381 mm to 1.27 mm). The grooves 26 may preferably have a pitch of from about 0.030 to 1.000 inches (30 mils to 1000 mils of from 0.762 mm to 25.4 mm). The polishing surface can have two or more different groove patterns, for example a combination of large grooves and small grooves. The grooves can be in the form of slanted grooves, concentric grooves, spiral or circular grooves, a combination of circular grooves and radial straight line or radial cured line grooves, or XY crosshatch pattern, and can be continuous or non-continuous in connectivity. Other useful patterns include those shown in U.S. Pat. No. 7,377,840 and Published Patent Application Nos. 2008/0211141 and 2009/0311955 A1. Desirably, the grooves are configured such that they direct the flow of polishing slurry across the surface of the transparent window portion (e.g. one or more grooves may go up to the outer edge of the plateau plane). Yet the grooves do not cover the top surface of the LAT. The groove sidewalls can also be sloped, e.g., either U-shaped or V-shaped or completely vertical.

Returning to FIG. 1, typically the polishing pad material is wetted with the chemical polishing liquid (also known as a polishing composition) 30. The choice of the polishing composition selected will greatly depend upon several factors including the processing conditions, workpiece being made, and the particular CMP apparatus employed.

The polishing head 12 applies pressure to the substrate 14 against the polishing pad 18 as the platen rotates about its central axis. In addition, the polishing head 12 is usually rotated about its central axis, and translated across the surface of the platen 16 via a drive shaft or translation arm 32. The pressure and relative motion between the substrate and the polishing surface, in conjunction with the polishing solution, result in polishing of the substrate.

An optical aperture 34 is formed in the top surface of the platen 16. An optical monitoring system, including a light source 36, such as a laser, and a detector 38, such as a photo detector, is located below the top surface of the platen 16. For example, the optical monitoring system is located in a chamber inside the platen 16 that is in optical communication with the optical aperture 34, and can rotate with the platen via a drive shaft 64. The optical aperture 34 can be filled with a transparent solid piece, such as a quartz block, or it can be an empty hole. In one implementation, the optical monitoring system and optical aperture are formed as part of a module that fits into a corresponding recess in the platen. Alternatively, the optical monitoring system could be a stationary system located below the platen, and the optical aperture could extend through the platen. The light source can employ a wavelength anywhere from the far infrared to ultraviolet, such as red light, although a broadband spectrum, e.g., white light, can also be used, and the detector can be a spectrometer.

A LAT 40 is formed in the overlying polishing pad 18 and aligned with the optical aperture 34 in the platen. The LAT 40 and aperture 34 can be positioned such that they have a view of the workpiece or substrate 14 held by the polishing head 12 during at least a portion of the platen's rotation, regardless of the translational position of the head 12. The light source 36 projects a light beam through the aperture 34 and the LAT 40 to impinge the surface of the overlying substrate 14 at least during a time when the LAT 40 is adjacent to the workpiece or substrate 14. Light reflected from the substrate forms a resultant beam that is detected by the detector 38. The light source and the detector are coupled to a computer (not shown) that receives the measured light intensity from the detector and uses it to determine the polishing endpoint, e.g., by detecting a sudden change in the reflectivity of the substrate that indicates the exposure of a new layer, by calculating the thickness removed from the outer layer (such as a transparent oxide layer) using interferometric principles, or by monitoring the signal for predetermined endpoint criteria.

One problem with placement of a normal large rectangular LAT (e.g., about 2.0 inch by about 0.5 inch LAT) into a very thin polishing layer is LAT delamination during polishing. In particular, the lateral frictional force from the substrate during polishing can be greater than the forces holding the compression molding of the LAT to the sidewall of the opaque portion of the pad, thereby separating the LAT from the opaque portion. The present invention overcomes that problem by having a recessed LAT along with also having strong covalent bonding between the sidewalls of the LAT and the adjacent sidewalls of the opaque region of the pad.

Returning to FIG. 2, the LAT 40 is thin along the direction of the frictional force applied by the substrate during polishing (tangential to a radius in the case of a rotating a polishing pad) and wide in the direction perpendicular direction (along a radius in the case of a rotating a polishing pad). For example, the LAT 40 can use an area about 0.5 inches wide and 2.0 inches long centered a distance D of about 7.5 inches (190.50 mm) from the center of the polishing pad 18 which has a radius of 15 inches.

The LAT 40 can have an approximately rectangular shape with its longer dimension substantially parallel to the radius of the polishing pad that passes through the center of the LAT 40. However, the LAT 40 is surrounded by a plateau plane 42, e.g., the plateau plane is preferably about 5 to about 50 mils wide and surrounds the whole perimeter of the rectangular LAT. This plateau plane has several advantages associated with it in the present pad. These advantages include ease of manufacturing and improved slurry flow over the surface of the LAT. Moreover, the plateau plane provides extra room to allow the support member to be removed from the cured LAT after the compression molding step.

Referring to FIG. 3, the LAT 40 is not as deep as the thickness of the polishing layer 20, so that the top surface 52 of the LAT 40 is not coplanar with the polishing surface 24 while the bottom surface 54 of the LAT is coplanar with a bottom surface 22 of the polishing layer. The straight sidewall perimeter of the LAT 40 can be secured, e.g., chemically bonded, to the inner sidewall edges of opaque portions 60 of the polishing layer 20. The planar plane 42 is shown on both sides of the top LAT surface 52.

Compared to its diameter, the polishing pad 40 is generally thin, e.g., less than 0.200 inches (200 mils or 5.08 mm), more preferably, from 0.050 to 0.150 inches (from 50 to 150 mils or from 1.27 mm to 3.81 mm). For example, the total thickness of the polishing layer 20, adhesive 28 and liner 44 can be about 0.140 inches. The polishing layer 20 may be about 0.130 inches thick, with the adhesive 28 and the liner 44 providing the remaining 0.1 inches. The grooves 26 may preferably be about one fourth to one half the depth of the polishing pad, e.g., roughly 0.015 to 0.050 inches (15 mils to 50 mils of from 0.381 mm to 1.27 mm). The thickness of the LAT is generally equal to the thickness of the polishing pad minus the depth of the grooves. If the pad thickness is about 0.200 inches and the groove depth is 0.050 inches, then the LAT thickness is about 0.150 inches. If the pad thickness is about 0.050 inch and the groove depth is 0.015 inches, then the LAT thickness is about 0.035 inches. If the pad thickness is about 0.130 inches and the groove depth is 0.035 inches, then the LAT thickness is about 0.095 inches.

Referring to FIG. 4, before installation on a platen, the polishing pad 18 can also include a release liner 44 that spans the adhesive layer 28 on the opaque bottom surface 22 (shown in FIGS. 3 and 5) and the LAT bottom surface 54 of the polishing pad. The liner is generally incompressible and also generally a fluid-impermeable layer, for example, polyethylene teraphthalate (PET), e.g., Mylar™ PET film. In use, the release liner is manually peeled from the polishing pad, and the polishing layer backside 20 is applied to the platen with the pressure sensitive adhesive 28.

To manufacture the polishing pad, initially the polishing layer 20 is formed and the bottom surface of the polishing layer 20 is then covered with the pressure sensitive adhesive 28 and a liner layer 44, as shown by FIG. 4. Grooves 26 are formed in-situ in the polishing layer 20 as part of a pad compression molding process before attachment of the pressure sensitive adhesive 28 and a liner layer 44.

The effective portion of the polishing pad 18 can include a polishing layer 20 with a polishing surface 24 to contact the substrate and bottom surfaces 22 and 54 to secure it to the platen 16 by an adhesive 28. The polishing pad 18 is made of at least one opaque region and at least one local area transparency region.

The opaque portion of the present LAT pad may be made by reacting a mixture containing urethane prepolymer, porogen, and filler with a curative to form an opaque buff-colored thermoset polyurethane or polyurea having a substantially uniform microcellular, closed cell structure. This opaque pad portion is not made from a plurality of polymeric materials and a mixture of polymeric materials is not formed by the above reaction. Instead, this opaque pad portion is made from non-polymeric urethane precursor that forms a single type of polyurethane polymer. Suitable opacifying fillers in the opaque portion of the pad, besides providing opacity to certain regions of the pad, may also provide improved lubricating behavior between the polishing pad and the workpiece being polished.

Urethane prepolymers are a preferred reactive chemistry for reaction injection molding to form the polishing layer of the polishing pad of this invention. "Prepolymers" are intended to mean any precursor to the final polymerized product, including oligomers and monomers. Many such prepolymers are well known and commercially available. Urethane prepolymers generally comprise reactive moieties at the ends of the prepolymer chains. Commercially available isocyanate prepolymers include di-isocyanate prepolymers and tri-isocyanate prepolymers. Examples of di-isocyanate prepolymers include toluene diisocyanate and methylene-diphenyl diisocyanate. Preferably, the isocyanate prepolymer comprises an average isocyanate functionality of at least two (i.e., at least two isocyanate reactive moieties in the prepolymer molecule). Average isocyanate functionality greater than 4 is generally not preferred, since processing of the resulting polymerized product can become difficult, depending upon the molding equipment and process used. Polyether prepolymers are particularly preferred. Examples of urethane and urea prepolymers useful in making the opaque portion of the pad include 80%-20% mixture of 2,4 and 2,6 isomers of toluene diisocyanate; 75%-25% mixture of 2,4 and 2,6 isomers of toluene diisocyanate; toluene diisocyanate polyfunctional isocyanates; methylene-diphenyl diisocyanate; polyether based toluene diisocyanate prepolymer; and polyether polytetramethylene glycol-toluene diisocyanate, as well as other prepolymers disclosed in US Published Patent Application No. 2006/0276109.

Examples of porogens useful in making the opaque portion of the pad include polymeric microspheres such as inorganic salts, sugars and water-soluble particles. Examples of such polymeric microspheres (or microelements) include polyvinyl alcohols, pectin, polyvinyl pyrrolidone, hydroxyethylcellulose, methylcellulose, hydropropylmethylcellulose, carboxymethylcellulose, hydroxypropylcellulose, polyacrylic acids, polyacrylamides, polyethylene glycols, polyhydroxyetheracrylites, starches, maleic acid copolymers, polyethylene oxide, polyurethanes, cyclodextrin and combinations thereof. One specific example of gas-filled expanded hollow microspheres that has been used as a porogen in adding porosity to CMP pads is pre-expanded gas-filled EXPANCEL acrylonitrile vinylidiene chloride microspheres available from Akzo Nobel of Sundsvall, Sweden. The preferred range of expanded hollow-polymeric microspheres' average diameters is from about 12 to about 80 .mu.m (microns). Note the diameter of the microspheres may be varied and different sizes or mixtures of different microspheres may be employed in the polymeric material if desired. Other porogens are disclosed in U.S. Pat. No. 6,648,733 and in US Published Patent Application No. 2006/0276109.

Examples of lubricant fillers useful in making the opaque portion of the pad include Teflon, cerium fluoride, PTFE., Nylon 6,6 6, PEK (polyether ketone), PEK (polyether ketone), PEEK (polyetheretherketone), PEKK (polyetherketoneketone), PEKEKK (polyetherketoneetherketoneketone), molybdenum sulfide, boron nitride, tungsten sulfide, graphite, graphite fluoride, niobium sulfide, tantalum sulfide, and magnesium silicate hydroxide (talc) as well as other lubricants disclosed in US Published Patent Application No. 2006/0276109.

Examples of curatives useful in making the opaque portion of the pad diethyltoluenediamine; di-(methyl thio)toluenediamine; 4,4' methylene-bis(3-chloro-2,6 dianiline); methylene dianiline; 4,4' methylene bis(orthochloroaniline); 4,4'-Methylenebis(2-chloroaniline); trimethylol propane (TMP); tri isopropanol amine (TIPA); trimethylene glycol di-p amino benzoate; ethylene glycol (>55%)+triethylenediamine; 1,4 butanediol; and thioether aromatic diamine as well other curative agents disclosed in US Published Patent Application No. 2006/0276109.

Additional ingredients such as chain extenders, polyols, light stabilizers, thermal stabilizers and the like may also be used to make the opaque portion.

The opaque pad portion of the pad contains opaque filler and a porogen whereas the transparent LAT portion does not require any opaque filler or porogen materials. Also, opaque pad portion of the pad will not have any water-soluble particles dispersed in the water-insoluble polymeric matrix opaque material. The opaque region is uniformly hydrophobic in nature. Upon conditioning, those conditioned portions will become more hydrophilic so as to be wettable. The average pore size will be from about 10 microns to about 100 microns, more preferably, from about 12 microns to about 90 microns.

The local area transparency insert will be made by reacting a urethane prepolymer with a curative. Urethane prepolymer and curatives listed above for making the opaque portion of the pad may be useful for making the LAT. Since it is desirable that the covalent bonding between the sidewalls of the LAT and the adjacent sidewalls of the opaque portion be as strong as possible, the use of the same prepolymer for the LAT and opaque portions may be preferred in some instances.

Additional ingredients such as fillers, porogens, chain extenders, polyols, light stabilizers, thermal stabilizers and the like may also be used to make the LAT portion. The transparent LAT portion is not made from a plurality of polymeric materials and a mixture of polymeric materials is not made by the above reaction. Instead, the present LAT insert pad portions are made from a non-polymeric urethane precursor that forms a single type of polyurethane or polyurea polymer. The resulting polymer for the present LAT is not a non-ambering urethane elastomer or does not have a refractive index intentionally designed to match the index of refraction of any slurry material to be used in a CMP process. The LAT portion of the present pad does not contain a clarifying material that causes the LAT to be more transparent. The LAT of the present invention will have a uniform single index of refraction throughout its volume. Also, water-soluble particles are not dispersed in this water-insoluble polymeric matrix LAT material. Further, the present LAT is not made of gas-permeable material or glass or crystalline material; silicone, poly(heptafluorobutacrylate) or poly(trifluorovinylacetate); or an acrylic-urethane oligomer or an acrylic-epoxy material. The present pad does not use any abrasive particles in either the LAT portion or the opaque portion. Also, it is not a type of material that turns from an opaque material in the non-compressed state and becomes translucent in the compressed state. The LAT insert will have no pores and thus will have no intrinsic ability to absorb or transfer slurry particles. In contrast, the opaque portion of the pad will have pores and thus will have the intrinsic ability to absorb or transfer slurry and slurry particles. Each pad will preferably have only one LAT; having more than one LAT in a pad is not preferred. Furthermore, a LAT that tilts from its top surface to its bottom surface (i.e. does not have vertical side walls) is not contemplated.

One preferred LAT is a 4-sided substantially rectangular cross-sectional shape (i.e. a 2 inch by 0.5 inch rectangle with radiused corners in the horizontal plane) (i.e. along the x,y-axis). However, other shapes may be contemplated in the future. In all vertical planes (i.e. along the z-axis), the LAT will have a vertical rectangular cross-sectional shape. In other words, each of the side walls of the LAT insert will be completely vertical. This facilitates the easy insertion of the LAT into the compression molding apparatus before molding. In contrast, the LAT inert will not be made of multiple sized sections such as a top hat design. Also, the sidewall surfaces of the LAT in a pad are not contemplated to be an uneven side surface such as a serrated shape, a wavy shape and a toothed shape. Furthermore, a tilting LAT from its top surface to its bottom surface is not contemplated. Such shaped would complicate the insertion of the LAT in to the compression molding apparatus.

LAT inserts are made by first adding the above-noted LAT insert prepolymer precursor ingredient (except for the curative) together in blend tank equipped with a mechanical stirrer, nitrogen gas head space a vacuum degassing system. The mixture after being thoroughly blended is transferred to a small mold via a mixing head where the curative is added to the mixture. A support member is then attached to the uncured LAT mixture. The transferred mixture is partially cured at a temperature for about 80 to 150 degrees C. for 1 to 20 minutes in the small mold to make a non-liquid, non-fully cured transparent gel-like plug or article of the desired LAT insert shape supported on the support member. The insert is partially cured solely by thermal energy, and not by photocuring or other technique. As shown in FIG. 5, a support member 62 that includes an epoxy holding block 46 with an adhesive layer on opposite ends (50 and 56) along with a polyimide film 48 attached to adhesive layer 50 are positioned in this small LAT mold before this partial curing step to support the LAT when it is placed in the larger pad mold. One surface of the polyimide film 48 becomes attached to the top surface 52 of the LAT during this partial curing step. The adhesive layer 56 on the other side of epoxy holding block is attached to a surface in the compression mold apparatus to hold the LAT/support member assembly in place during the molding operation.

This gel-like LAT and support member insert is then placed in an area in the CMP LAT pad making apparatus (e.g. a compressive molding apparatus) that is designed to accept and position the LAT gel and support member. The process of the present invention does not contemplate using a polymeric sleeve to hold the gel insert in the mold. The LAT insert is positioned in the pad mold so that the top of the transparent LAT insert is below the top of the polishing surface (or top of the groove area) in the mold. It is not contemplated to have the opaque portion of the present pad extend over either the top or bottom surfaces of the present LAT insert. The LAT portion of the present pad is a non-compressible solid when fully cured. After being put in place and co-cured with the opaque portion, it is no longer a gel-like material that can be compressed nor is it an inorganic/organic hybrid sol-gel material. The relative wear rate of the LAT portion (compared to the wear rate of the opaque portion) is immaterial because the location of the upper surface of the LAT is below the polishing surface and thus it is not subject to wear. Since the gel-like LAT and support member insert is made in a small mold and added to the pad mold a sufficient amount of time before the opaque liquid is added to the mold, the gel-like LAT and support member insert will cool below its quench temperature. In other words, it is not hot when added to the pad mold.

The liquid opaque pad polymeric precursor mixture is separately made by blending the above-noted ingredients (except the curative) in a blend tank equipped with a mechanical stirrer and nitrogen gas head space. The mixture after being thoroughly mixed is transferred to a day tank. When ready for use, the mixture is transferred to the CMP LAT pad mold via a mixing head where the curative is added. The opaque precursor mix is added into the mold to fill up the rest of the mold and generally surround the LAT insert. One suitable mixing apparatus used in this operation is called a Baule mixing system.

Before adding the gel-like LAT and support member insert and the opaque portion, the compression mold is preheated to about 110 to 135 degrees C. After the insert is positioned in the mold and opaque portion fills the rest of the mold, the mold is closed and heated for about 8 to 15 minutes to partially cure the opaque material and further cure the transparent material. The compressive force in the compression molding apparatus may range from about 1000 pounds to 30000 pounds force or higher. Because the thermal mass of the top and bottom portions of the mold make it impractical to cycle the mold temperature during the production of the LAT pad, the inside of the mold stays at about the same processing temperature consistently while production is going on. Because the LAT insert is made in a small mold and added to the pad mold a sufficient amount of time before the opaque liquid is added so that the LAT insert cools below its quench temperature. In other words, LAT/support member insert is not preheated up to the molding temperature prior to adding to the pad mold. During this curing, the sidewalls of the LAT start to become covalently bonded to the adjacent sidewalls of the opaque portion of the pad, thus forming a strong pad where the LAT and opaque regions are strongly bound together. This covalent bonding is much stronger than either the bonding between previously cured LATs and uncured opaque area or previously cured opaque area with uncured LATs as suggested in the prior art references. The plateau sidewall and groove areas are also formed in-situ during this compression molding step. The plateau plane surrounding the top opening (and thus the top surface of the resulting LAT) has a width of about 5 mils to about 50 mils. The combination of strong sidewall covalent bonding with simultaneously creating in-situ grooves and plateau plane features in one molding step effects a very efficient and economic process of making CMP polishing pads.

Compression molding is a method of molding in which the molding material is placed in an open heated mold cavity. The mold is closed with a top force or plug member and pressure is applied to force the molding material into contact with all internal mold areas. Heat and pressure is maintained until the molding material has been sufficiently cured so that the resulting pad can be easily removed from the mold apparatus (i.e. demolded).

After the curing time is complete, the partially cured material which is a solid is "demolded" and removed from the mold. The support member is also removed from the top surface of the LAT. The plateau plane surrounding the top surface of the LAT allows for the easy removal of the support member from the LAT. The now exposed top surface of the LAT is a smooth surface positioned between the top polishing surface and the bottom surface of the polishing pad. The top surface of the LAT insert will not have a pattern or grooves designed into it. Only the top surface of the opaque portion of the pad will have the groove design in it.

A plateau region exists around the edges of the upper surface of the LAT. Thus, the LAT edges will not merge with sidewalls of the groove area, but will be positioned a short distance away from it. The polishing surface of the present pad is an opaque grooved polishing surface. Transparent grooves are not contemplated for this LAT pad.

The solid partially cured pad is then preferably moved to a curing oven and heated for 8 to 24 hours at about 80 to 110 degrees C. to complete the curing of both the LAT and opaque portions of the pad. This oven curing is not required if it is desired to complete the pad curing in the compression molding apparatus. The straight sidewalls of the LAT are chemically bonded directly by this thermal heating to the surrounding opaque area. The LAT will have a clear structurally distinct boundary with opaque portions of the pad, will be fixed in place in the pad and will not move independently of the opaque portion of the pad. No intermediate adhesive layer is needed between the LAT sidewalls and the surrounding opaque region. Because the LAT and the opaque area are co-cured together, the resulting chemical bonding is stronger than when a completely cured LAT and uncured opaque material are heated together or when an uncured LAT and a completely cured opaque area are heated together. For example, the present invention does not form a hole or aperture in cured opaque pad and then fill that hole or aperture with a transparent LAT insert. Instead, an opaque pad is molded around a preformed partially cured transparent gel-like article to form the LAT-containing polishing pad. Also, ultrasonic welding to attach the LAT to the opaque portion of the pad is not contemplated.

The cured pad is removed from the oven and then the back side of the pad and the LAT insert is machined (the front or grooved side needed not be treated at all) so that the bottom surface of the opaque portion of the pad is flush with the bottom surface of the LAT. Also, the machining causes the desired pad thickness to be achieved. The smooth bottom surface of the LAT is modified by the machining so that the bottom surface of the cured thermoset polyurethane or polyurea local area transparency material is co-planar with the bottom surface of the opaque portions of the pad. The bottom surfaces of both the opaque portion and the LAT insert of the present pad do not have a designed pattern. Moreover, these bottom surfaces will have a uniform surface across the whole bottom of the LAT. The perimeter portion of the bottom surface will not be rougher than the center portion. The hardness of the opaque region of the pad is from about 25 to about 75 Shore D, the hardness of the LAT is from about 25 to about 75 Shore D, the density of the opaque region of the pad is from about 0.6 to 1.2 grams per cubic centimeter, and the density of the LAT is from about 1 to about 1.2 grams per cubic centimeter.

A "transfer adhesive film" is then placed over the bottom surface of the cured and machined pad. This "transfer adhesive film" is simply a roll of a pressure sensitive adhesive layer adhered to a release liner. It is unrolled and the adhesive layer is then adhered to the bottom surface of the LAT pad. The release liner is left in contact with that adhesive layer. Thus, a composite of the pad/adhesive layer/release layer is created. The transfer adhesive film is positioned and cut so that both the adhesive and the release liner cover the overall bottom surface of the pad. The release liner is preferably a layer of MYLAR polyethylene teraphthalate film that is preferably about 0.5 to 5 mils thick. Alternatively, paper release liner up to 10 mils thick may be used. Similar thickness paper or polypropylene layers may be alternative choices for this release liner. The pressure sensitive adhesive positioned between the bottom surface of the polishing pad and the release liner is a releasable-bond type adhesive that is either an acrylic or rubber type having transparency properties suitable for this intended use. The bottom surface of the LAT will be flush with the bottom surface of the opaque pad material so that the PET film will form a flat sheet across the total bottom surface of the pad. The PET release liner will not have any holes or openings in it.

This composite is then cleaned, inspected and packed for shipment to the end-user.

The end-user, when ready to use the pad, removes the release liner from the composite, exposing the adhesive layer.

The end-user then positions the remainder of the composite against the CMP machine platen with the exposed adhesive layer adhering to the platen. The end-user disposes of the removed release liner after removal. A subpad is not contemplated being using below the release liner.

The polishing pad of the invention is particularly suited for use in conjunction with a chemical-mechanical polishing (CMP) apparatus. Typically, the apparatus comprises a platen, which, when in use, is in motion and has a velocity that results from orbital, linear, or circular motion, a polishing pad of the invention in contact with the platen and moving with the platen when in motion, and a carrier that holds a workpiece to be polished by contacting and moving relative to the surface of the polishing pad. The polishing of the workpiece takes place by the workpiece being placed in contact with the polishing pad and then the polishing pad moving relative to the workpiece, typically with a polishing composition there between, so as to abrade at least a portion of the workpiece to polish the workpiece. The polishing composition typically comprises a liquid carrier (e.g., an aqueous carrier), a pH adjustor, and optionally an abrasive. Depending on the type of workpiece being polished, the polishing composition optionally may further comprise oxidizing agents, organic acids, complexing agents, pH buffers, surfactants, corrosion inhibitors, anti-foaming agents, and the like. The CMP apparatus can be any suitable CMP apparatus, many of which are known in the art. The polishing pad of the invention also can be used with linear polishing tools.

Desirably, the CMP apparatus further comprises an in situ polishing endpoint detection system, many of which are known in the art. Techniques for inspecting and monitoring the polishing process by analyzing light or other radiation reflected from a surface of the workpiece are known in the art. Such methods are described, for example, in U.S. Pat. No. 5,196,353, U.S. Pat. No. 5,433,651, U.S. Pat. No. 5,609,511, U.S. Pat. No. 5,643,046, U.S. Pat. No. 5,658,183, U.S. Pat. No. 5,730,642, U.S. Pat. No. 5,838,447, U.S. Pat. No. 5,872,633, U.S. Pat. No. 5,893,796, U.S. Pat. No. 5,949,927 and U.S. Pat. No. 5,964,643. Desirably, the inspection or monitoring of the progress of the polishing process with respect to a workpiece being polished enables the determination of the polishing end-point, i.e., the determination of when to terminate the polishing process with respect to a particular workpiece.

The polishing pad of the invention is suitable for use in a method of polishing many types of workpieces (e.g., substrates or wafers) and workpiece materials. For example, the polishing pads can be used to polish workpieces including memory storage devices, glass substrates, memory or rigid disks, metals (e.g., noble metals), magnetic heads, inter-layer dielectric (ILD) layers, polymeric films, low and high dielectric constant films, ferroelectrics, micro-electro-mechanical systems (MEMS), semiconductor wafers, field emission displays, and other microelectronic substrates, especially microelectronic substrates comprising insulating layers (e.g., metal oxide, silicon nitride, or low dielectric materials) and/or metal-containing layers (e.g., copper, tantalum, tungsten, aluminum, nickel, titanium, platinum, ruthenium, rhodium, iridium, alloys thereof, and mixtures thereof). The term "memory or rigid disk" refers to any magnetic disk, hard disk, rigid disk, or memory disk for retaining information in electromagnetic form. Memory or rigid disks typically have a surface that comprises nickel-phosphorus, but the surface can comprise any other suitable material. Suitable metal oxide insulating layers include, for example, alumina, silica, titania, ceria, zirconia, germania, magnesia, and combinations thereof. In addition, the workpiece can comprise, consist essentially of, or consist of any suitable metal composite. Suitable metal composites include, for example, metal nitrides (e.g., tantalum nitride, titanium nitride, and tungsten nitride), metal carbides (e.g., silicon carbide and tungsten carbide), nickel-phosphorus, alumino-borosilicate, borosilicate glass, phosphosilicate glass (PSG), borophosphosilicate glass (BPSG), silicon/germanium alloys, and silicon/germanium/carbon alloys. The workpiece also can comprise, consist essentially of, or consist of any suitable semiconductor base material. Suitable semiconductor base materials include single-crystal silicon, poly-crystalline silicon, amorphous silicon, silicon-on-insulator, and gallium arsenide. The substrate can be, for example, a product substrate (e.g., which includes multiple memory or processor dies), a test substrate, a bare substrate, and a gating substrate. The substrate can be at various stages of integrated circuit fabrication, e.g., the substrate can be a bare wafer, or it can include one or more deposited and/or patterned layers. The term substrate can include circular disks and rectangular sheets.

In order to make the pads of the present invention simple to make and use, several prior art structures or operations that have be disclosed as being useful in CMP polishing pads are expressly not desired or contemplated for the present invention. Specifically, a deformable member such as a jelly elastomer between the bottom of the LAT insert and the PET film is not contemplated. Also, an indentation into the bottom surface of the pad or a void created between the bottom of the LAT and the PET film is not contemplated. Furthermore, a tilting LAT from its top surface to its bottom surface is not contemplated. No drainage channel from the LAT insert to the edge of the pad is designed into the pad of the present invention. Also, an anti-scattering layer positioned over the top or bottom surfaces of the present LAT is not contemplated. No electronic or mechanical sensing means or measuring devices located within either the LAT portion or the opaque portion of the pad are contemplated for the present polishing pad. The LAT in the present pad will not have an anti-fouling treatment on the top or bottom surfaces to prevent slurry material from sticking to those surfaces and hindering the endpoint detection. The top and bottom surfaces of the present LAT will not be treated with a corona treatment, flame treatment or fluorine gas treatment. The release liner will be attached to the LAT and opaque portions of the pad by a single adhesive layer. A combination of 2 different adhesives between that release liner and the present LAT pad or using no-adhesive means to adhere the release liner to the bottom pad surface is not contemplated. Also, using an epoxy resin adhesive to adhere the pad to the PET film is not contemplated. The present pad does not have an intermediate material between the LAT sidewalls and the adjacent opaque sidewalls and will not have any porous fibrous matrix in either the LAT insert portion or the opaque portion. Adding magnetic particles to the release liner of the present LAT pad is not contemplated. It is not contemplated to use laser ablation to remove surface roughness in the lower surface of the LAT insert and/or forming micro-lens by said laser ablation. It is not contemplated to have a gas region positioned between the present pad and the platen during polishing and controlling the temperature of that gas region during polishing. It is not contemplated to have to use any gas flushing system to flush away liquid condensation from the bottom surface of the present LAT during use. The present co-curing does not employ a two-stage cooling process during pad molding to first allow a LAT region of the pad to form by fast cooling and then allow the opaque region to form by slow cooling.

All references, including publications, patent applications, and patents, cited herein are hereby incorporated by reference to the same extent as if each reference were individually and specifically indicated to be incorporated by reference and were set forth in its entirety herein.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. It is intended that the present invention cover the modifications and variations of this invention provided they come within the scope of the appended claims and their equivalents. Although specific terms are employed herein, they are used in a generic and descriptive sense only and not for purposes of limitation.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

That which is claimed:

1. A method of fabricating a CMP polishing pad, the method comprising:

providing a first assembly of a non-liquid, only partially cured thermoset polyurethane or polyurea local area transparency intermediate material having one surface affixed to a support member;

positioning said first assembly in a polishing pad making apparatus wherein the affixed surface of the non-liquid, only partially cured thermoset polyurethane or polyurea local area transparency intermediate material is located between a polishing surface region and a bottom surface region of a polishing pad formation region in the polishing pad making apparatus, and wherein the support member of the first assembly is accommodated in the polishing pad making apparatus and located proximate to the polishing surface region and distal from the bottom surface region of the polishing pad formation region in the polishing pad making apparatus;

introducing opaque thermoset polyurethane or polyurea intermediate material into said polishing pad making apparatus;

co-curing the non-liquid, only partially cured thermoset polyurethane or polyurea thermoset local area transparency intermediate material and the opaque thermoset intermediate material to form a polishing layer having a polishing surface and a back surface opposite said polishing surface, the polishing layer comprising a local area transparency (LAT) region disposed in and covalently bonded directly to an opaque polishing region, the LAT region transparent in its entirety; and subsequent to the co-curing, removing the support member.

2. The method of claim 1 further comprising removing a back portion of the polishing layer to form a polishing pad of predetermined desired thickness, said removing step creating a new bottom surface of the LAT region so that the LAT region is co-planar with the back surface of the polishing layer.

3. The method of claim 2 further comprising attaching an aperture-free removable release sheet covering at least a portion of said back surface of the polishing layer with an adhesive layer interposed between said polishing layer and said release sheet; said adhesive layer capable of adhering the polishing layer to a platen of a CMP apparatus after said release sheet has been removed.

4. The method of claim 1, wherein the opaque polishing region is a cured closed cell, thermoset polyurethane or polyurea opaque polishing region having a porosity from about 10% to about 55% by volume.

5. The method of claim 1, wherein the polishing layer has a thickness from about 50 mils to about 200 mils and the thickness of the LAT region is from about 35 to about 150 mils.

6. The method of claim 1, wherein a groove pattern is positioned in the opaque polishing region, and the LAT region is flat and with no groove pattern.

7. The method of claim 6, wherein the groove pattern has a depth of about 15 mils to about 100 mils, groove widths of about 15 mils to about 50 mils, and a groove pitch from about 30 mils to about 1000 mils.

8. The method of claim 1, wherein the hardness of the opaque polishing region is from about 25 to about 75 Shore D, the hardness of the LAT region is from about 25 to about 75 Shore D, the density of the opaque polishing region is from about 0.6 to 1.2 grams per centimeter, and the density of the LAT region is from about 1 to about 1.2 grams per cubic centimeter.

9. The method of claim 1, wherein the non-liquid, only partially cured thermoset polyurethane or polyurea local area transparency intermediate material has a temperature less than its quench temperature during the positioning of said first assembly in the polishing pad making apparatus.

10. The method of claim 1, wherein the support member comprises a polymeric film having one surface attached to the non-liquid, only partially cured local area transparency intermediate material surface and having an opposite surface attached to a holding member by an adhesive layer.

11. The method of claim 10, wherein the polymeric film is a polyimide film.

12. The method of claim 10, wherein the holding member is an epoxy resin block.

13. The method of claim 1, wherein the polishing pad making apparatus is a compression molding apparatus.

* * * * *